US009650853B2

(12) United States Patent
Lehr

(10) Patent No.: US 9,650,853 B2
(45) Date of Patent: May 16, 2017

(54) DOWNHOLE CUTTING AND JACKING SYSTEM

(71) Applicant: Baker Hughes Incorporated, Houston, TX (US)

(72) Inventor: Douglas J. Lehr, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 292 days.

(21) Appl. No.: 14/605,467

(22) Filed: Jan. 26, 2015

(65) Prior Publication Data

US 2016/0215580 A1 Jul. 28, 2016

(51) Int. Cl.
*E21B 23/01* (2006.01)
*E21B 29/00* (2006.01)

(52) U.S. Cl.
CPC ..... *E21B 23/01* (2013.01); *E21B 29/002* (2013.01)

(58) Field of Classification Search
None
See application file for complete search history.

(56) References Cited

U.S. PATENT DOCUMENTS 2,015,277 A * 9/1935 McCullough ..... E21B 29/005 166/55.7
2,169,217 A * 8/1939 Brown ..... E21B 29/005 166/55.7
2,202,986 A * 6/1940 Ellis ..... E21B 29/005 166/55.7
2,302,567 A * 11/1942 O'Neill ..... E21B 29/00 166/223
3,314,478 A * 4/1967 Burns ..... E21B 43/10 166/208
4,889,187 A * 12/1989 Terrell ..... E21B 29/02 166/298
5,183,111 A * 2/1993 Schellstede ..... E21B 7/18 166/212
5,318,115 A 6/1994 Rouse
6,357,528 B1 3/2002 Davis et al.
8,869,896 B2 10/2014 Crow et al.
(Continued)

OTHER PUBLICATIONS

Korean Intellectual Property Office; International Searching Authority; International Search Report and Written Opinion for Application No. PCT/US2016/013948 dated Apr. 25, 2016.
(Continued)

*Primary Examiner* — Shane Bomar
(74) *Attorney, Agent, or Firm* — Parsons Behle & Latimer

(57) ABSTRACT

A downhole tool that includes a cutter and jacking system and methods of using such a tool to remove a portion of casing or tubing from a wellbore. The tool may include an upper slip and a lower slip configured to selectively engage casing of a wellbore. A cutter and an extendable section may be positioned between the upper and lower slips. The cutter may be used to cut casing into an upper portion and a lower portion and the extendable section may be used to increase a distance between the upper and lower slips that moves the upper portion of the casing and the lower portion of the casing away from each other. The extendable section may be hydraulically actuated to move the upper portion of the casing away from the lower portion of the casing. The cutter may be an abrasive jet configured to cut the casing.

19 Claims, 2 Drawing Sheets

(56) References Cited

U.S. PATENT DOCUMENTS

| | | | | |
|---|---|---|---|---|
| 8,881,818 | B2 | 11/2014 | Crow et al. | |
| 8,893,791 | B2 | 11/2014 | Crow et al. | |
| 2002/0139539 | A1 | 10/2002 | Hoffman et al. | |
| 2008/0053652 | A1 | 3/2008 | Corre et al. | |
| 2011/0000668 | A1* | 1/2011 | Tunget | E21B 23/14 166/285 |
| 2014/0231087 | A1 | 8/2014 | Orstad | |

OTHER PUBLICATIONS

Segura, Drillpipe Cutting at Ultrahigh Pressure Proven for Remediating Deepwater Stuck-Pipe Hazards, SPE Drilling & Completion, Amsterdam, p. 569-577, Dec. 2011.

* cited by examiner

DOWNHOLE CUTTING AND JACKING SYSTEM

BACKGROUND

Field of the Disclosure

The embodiments described herein relate to a downhole tool that includes a cutter and jacking system and methods of using such a tool.

Description of the Related Art

It may be desirable to remove a portion of a casing and/or tubing from a wellbore. For example, the removal of an upper portion of a casing is often done during permanent abandonment operation on a wellbore. Such a procedure is done in an attempt to be able to place a sealing device, such as a cement plug, in intimate sealing contact with the wellbore formation. Often the casing is cut at a particular depth using a mechanical or abrasive cutter. After the casing has been cut, the casing is attempted to be pulled out of the wellbore at the surface. Often, the casing may be stuck and/or difficult to retrieve from the wellbore. For example, cement or other material, such as barite, may have settled between the casing and the wellbore formation. Stuck casings may require a substantial force at the surface in an attempt to overcome the sticking forces. The application of such forces at the surface may not be convenient, may present safety issues, and/or may be harmful to surface equipment such as drawworks. Other drawbacks of current systems also exist.

SUMMARY

The present disclosure is directed to a downhole system and method that overcomes some of the problems and disadvantages discussed above.

One embodiment of the disclosure is a downhole system comprising an upper slip configured to selectively engage casing of a wellbore, a lower slip configured to selectively engage casing of the wellbore, and a cutter positioned between the upper and lower slips. The cutter is configured to radially cut casing of the wellbore. The system comprises an extendable section positioned between the upper and lower slips. The extendable section is configured to increase a distance between the upper slip and the lower slip.

The extendable section of the system may be hydraulically actuated. The system may include an emergency disconnect positioned between the cutter and the extendable section, wherein the emergency disconnect is configured to release the upper slip and extendable section from the lower slip and the cutter. The cutter may be an abrasive jet. The system may include a work string connected to the upper slip. The work string may be rotated to rotate the cutter. The system may include a mule shoe sub connected below the lower slip. The upper and lower slips may be hydraulically actuated. The upper and lower slips may be actuated individually.

One embodiment of the disclosure is a method of removing a portion of casing of a wellbore. The method comprises running a tool on a work string into a wellbore, the tool having an upper slip and a lower slip. The method comprises setting the lower slip against casing in the wellbore and setting the upper slip against casing in the wellbore. The method comprises cutting the casing to form an upper portion and lower portion. The method comprises increasing a distance between the upper slip and the lower slip after cutting the casing and removing the upper portion of the casing from the wellbore.

The method may comprise applying an upward force with the upper slip against the casing during cutting of the casing. Increasing the distance between the upper slip and the lower slip may comprise moving the upper portion of the casing away from the lower portion of the casing. Increasing the distance may comprise pumping fluid down the work string extending an extendable section positioned between the upper and lower slips. Cutting the casing may comprise pumping an abrasive fluid out of a ported sub. Cutting the casing may comprise rotating the work string while pumping the abrasive fluid out of the ported sub. The method may comprise unsetting the lower slip prior to removing the upper portion of the casing from the wellbore. Removing the upper portion of the casing may comprise pulling the work string out of the wellbore, wherein the upper slip engages the upper portion of the casing. The method may comprise disconnecting the lower sup from the tool after cutting the casing and before removing the upper portion of the casing from the wellbore.

Figure 1:
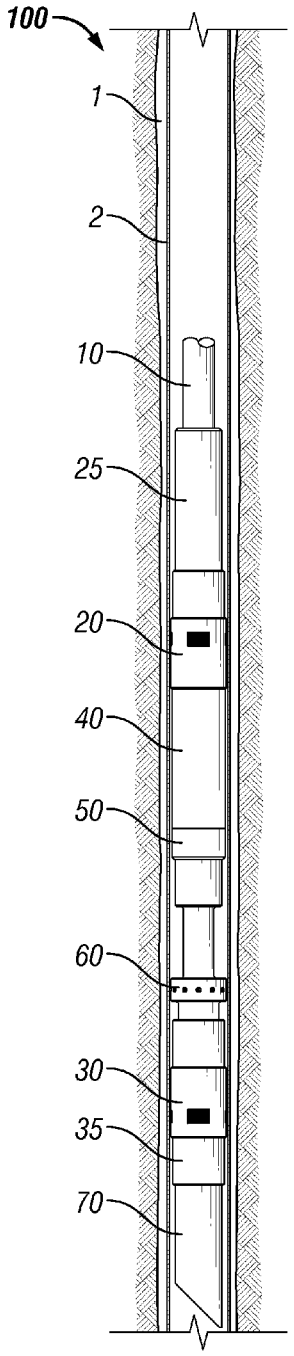
FIG. 1 shows an embodiment of a tool that includes a cutter and jacking system positioned with a portion of a wellbore.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

FIG. 1 shows an embodiment of a tool 100 that is positioned within the casing or tubing 2, hereafter referred to as casing, of a wellbore 1. The tool 100 is connected to a work string 10, which may be used to position the tool 100 at a desired location with the wellbore 1 as well as possibly being used to operate the different functions of the tool 100. The work string 10 could be various types of work string 10 that may be used to convey the tool 100 into the wellbore 1 and position at a desired location. For example, the work string 10 may be, but is not limited to, a coiled tubing string or a jointed pipe string. The tool 100 includes an upper slip 20 and a lower slip 30. The slips 20 and 30 may be used to engage the inner diameter of the casing 2 and hold the tool 100 in place at a location within the wellbore 1. The tool 100 may include a hydraulic section 25 that is used to actuate the upper slips 20 between an unset positioned and a set position against the inner diameter of the casing 2. The tool 100 may also include a hydraulic section 35 that is used to actuate the lower slips 30 between an unset positioned and a set position against the inner diameter of the casing 2. Various mechanisms may be used to selectively set the upper and lower slips 20 and 30. For example, an individual ball may be pumped down the work string 10 to individually actuate the upper and lower slips 20 and 30 by subsequent pressure within the work string 10. The slips 20 and 30 may each be actuated individually as will be described herein.

Positioned between the upper and lower slips 20 and 30 the tool 100 includes an extendable section 40, an emergency disconnect 50, and a cutter 60, the operation of each of these components will be described herein. Positioned below the lower sub 30 may be a sub 70, which aids in the insertion of the tool 100 into the wellbore 1. For example the sub 70 may be a mule shoe entry sub, half mule shoe, indexing shoe, or other sub configured to aid in the insertion of the tool 100 into the wellbore 1 as would be appreciated by one or ordinary skill of art having the benefit of this disclosure.

Figure 2:
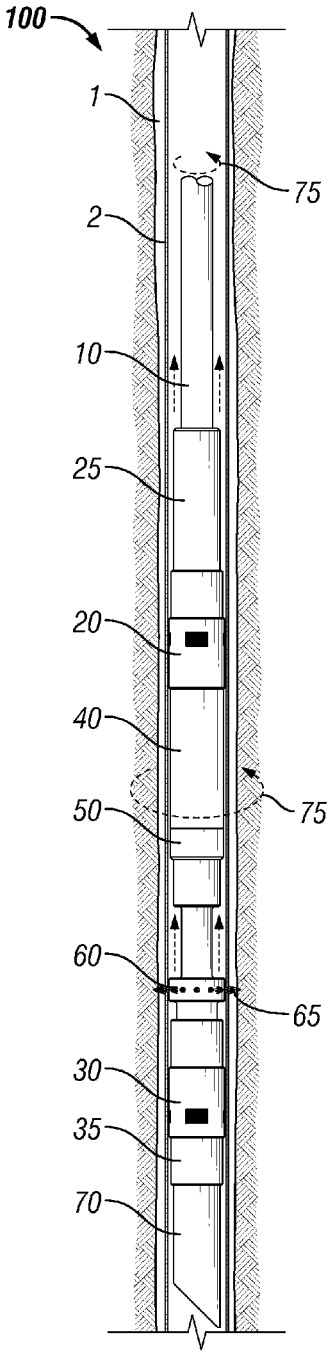
FIG. 2 shows an embodiment of a tool cutting a portion of casing within a wellbore.

FIG. 2 shows the tool 100 with the upper and lower slips 20 and 30 engaging the casing 2 of the wellbore 1. As discussed above, various mechanisms may be used to individual set the upper and lower slips 20 and 30. The lower slip 30 may be set against the casing 2 first followed by setting the upper slip 20 against the casing 2. The tool 100 may be used to cut the casing 2 into an upper portion 2*a* and a lower portion 2*b* with the cutter 60 as shown in FIG. 2. The cutter 60 may be a jetted sub through which an abrasive fluid 65 may be pumped to cut the casing 2. The abrasive fluid 65 may be pumped from the surface through the work string 10 to the cutter 60. The cutter 60 may be adapted with jetted nozzles to increase the effectiveness of the abrasive fluid. To ensure that the lower portion of the casing 2*b* is cut free from the upper portion 2*a*, the cutter 60 may be rotated during the cutting processes by the rotation of the work string 10, which is indicated by arrows 75. Alternatively, the cutter 60 could be a mechanical cutter or use explosives to cut the casing 2. The cutter 60 may be a mechanical cutter that utilizes blades or knives that are powered by fluid flow. The cutter 60 may be a ballistic cutter, such as a plasma or thermite cutter. The cutter 60 may be a mechanical motorized rotary cutter, which could be powered by electrical power. For example, a battery pack could power the cutter 60.

Figure 3:
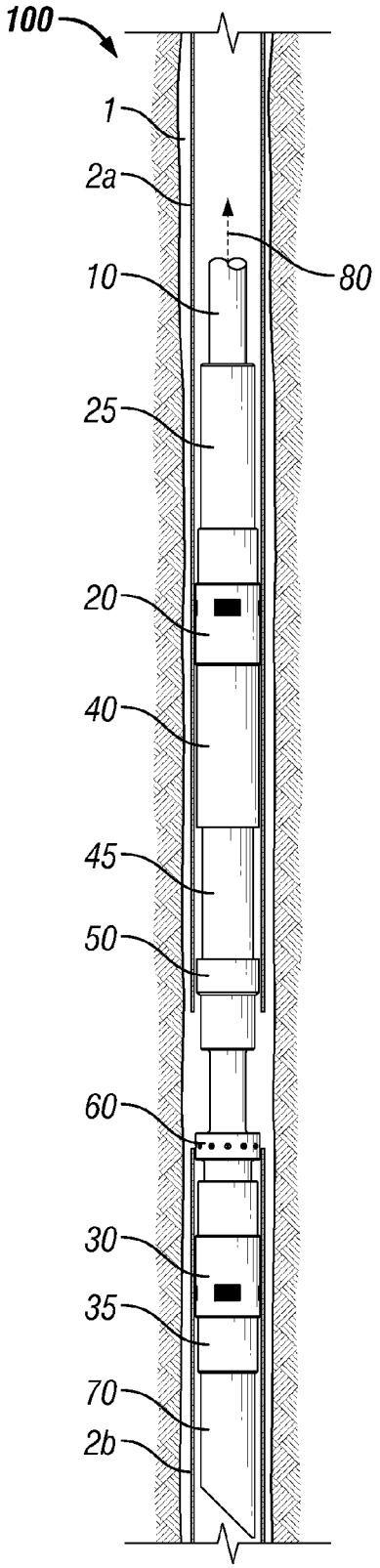
FIG. 3 shows an embodiment of a tool that has hydraulically moved an upper portion of casing away from a lower portion of casing.

FIG. 3 shows the casing upper portion 2*a* separated from the casing lower portion 2*b*. After the cutter 60 has cut through the casing 2, the extendable section 40 may be used to move the upper slip 20 away from the lower slip 30. As the upper slip 20 is engaged with the casing upper portion 2*a*, the movement of the upper slip 20 away from the lower slip 30 also moves the upper casing portion 2*a* away from the lower casing portion 2*b*. The extendable section 40 may be hydraulically actuated and extending by movement of an outer tubing or portion 40 with respect to an inner portion or tubing 45. The extendable section 40 may be extended by pumping fluid down the work string 10 to the extendable section 40. As shown in FIG. 3, the extendable section 40 and 45 may be used to move the casing upper portion 2*a*, which may permit the work string 10 to remove the casing upper portion 2*a* from the wellbore 1. As discussed above, casings 2 within a wellbore 1 may stick to the wellbore 1 making it difficult to be removed even after a cutting operation. The extendable section 40 and 45 of the tool 100 uses hydraulic force down hole to begin movement of a portion of the casing 2*a*, which may make it easier for the portion of casing 2*a* to later be removed from the wellbore 1.

The extendable section 40 and 45 could also be used to apply force to the casing 2 as it is being cut by the cutter 60. The use of the extendable section 40 and 45 could pretension the casing 2 during the cutting operation so that up completion of a cut completely around the casing 2 the casing upper portion 2*a* may move away from the lower casing portion 2*b* due to the pretension. The use of a pretension force on the casing 2 may make it easier to remove the casing upper portion 2*a* from the wellbore 1.

Figure 4:
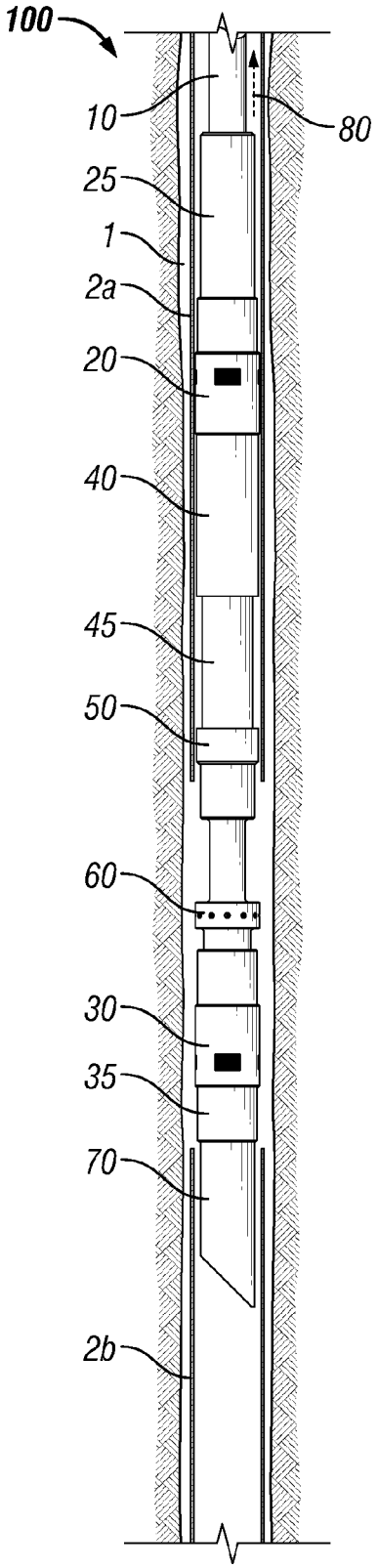
FIG. 4 shows an embodiment of a tool removing a portion of casing from a wellbore.

FIG. 4 shows the casing upper portion 2*a* being removed from the wellbore 1. The lower slip 30 of the tool 100 will be unset from the casing lower portion 2*b* permitting the work string 10 to pull both the tool 100 and the casing upper portion 2*a* from the wellbore 1. The upper slip 20 remains set against the casing upper portion 2*a* so that the casing upper portion 2*a* is removed from the wellbore 1 as the work string 10 and tool 100 are pulled to the surface. The tool 100 includes an emergency disconnect 50 positioned between the upper and lower slips 20 and 30. The emergency disconnect 50 permits the disconnection of the lower portion of the tool 100 in the event that the lower portion of the tool 100 becomes stuck within the wellbore. For example, in the event that the lower slip 30 does not disengage with the casing lower portion 2*b*, the emergency disconnect can be utilized to permit the upper portion of the tool 100 as well as the casing upper portion 2*a* to be removed from the wellbore 1 via the work string 10.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A downhole system comprising:

an upper slip configured to selectively engage casing of a wellbore;

a lower slip configured to selectively engage casing of the wellbore;

a cutter positioned between the upper and lower slips, the cutter configured to radially cut casing of the wellbore; and an extendable section positioned between the upper and lower slips, wherein the extendable section is configured to increase a distance between the upper slip and the lower slip and apply an upward force with the upper slip against the casing.

2. The system of claim 1, wherein the extendable section is hydraulically actuated.

3. The system of claim 2, further comprising an emergency disconnect positioned between the cutter and the extendable section, wherein the emergency disconnect is configured to release the upper slip and extendable section from the lower slip and cutter.

4. The system of claim 1, wherein the cutter further comprises an abrasive jet.

5. The system of claim 1, further comprising a work string connected to the upper slip.

6. The system of claim 5, wherein the work string may be rotated to rotate the cutter.

7. The system of claim 6, further comprising a mule shoe sub connected below the lower slip.

8. The system of claim 7, wherein the upper and lower slips are hydraulically actuated.

9. The system of claim 8, wherein the upper and lower slips may be actuated individually.

10. A method of removing a portion of casing of a wellbore using a tool on a work string, the tool having an upper slip and a lower slip comprising:

setting the lower slip against casing in the wellbore;

setting the upper slip against casing in the wellbore;

cutting the casing to form an upper portion and a lower portion;

applying an upward force with the upper slip against the casing during cutting of the casing; and increasing a distance between the upper slip and the lower slip after cutting the casing.

11. The method of claim 10, further comprising removing the upper portion of the casing from the wellbore.

12. The method of claim 11, further comprising unsetting the lower slip from the casing prior to removing the upper portion of the casing.

13. The method of claim 12, wherein removing the upper portion of the casing further comprises pulling the work string out of the wellbore wherein the upper slip engages the upper portion of the casing.

14. The method of claim 11, further comprising disconnecting the lower sub from the tool after cutting the casing and before removing the upper portion of the casing from the wellbore.

15. The method of claim 14, wherein removing the upper portion of the casing further comprises pulling the work string out of the wellbore wherein the upper slip engages the upper portion of the casing.

16. A method of removing a portion of casing of a wellbore comprising:

running a tool on a work string into a wellbore, the tool having an upper slip and a lower slip;

setting the lower slip against casing in the wellbore;

setting the upper slip against casing in the wellbore;

cutting the casing to form an upper portion and a lower portion; and increasing a distance between the upper slip and the lower slip after cutting the casing, wherein increasing the distance between the upper slip and the lower slip further comprises moving the upper portion of the casing away from the lower portion of the casing.

17. The method of claim 16, wherein increasing the distance further comprises pumping fluid down the work string extending an extendable section positioned between the upper and lower slips.

18. The method of claim 17, wherein cutting the casing further comprises pumping an abrasive fluid out of a ported sub.

19. The method of claim 18, wherein cutting the casing further comprises rotating the work string while pumping the abrasive fluid out of the port sub.

* * * * *